US008054243B2

(12) United States Patent
Sokolov et al.

(10) Patent No.: US 8,054,243 B2
(45) Date of Patent: Nov. 8, 2011

(54) METHOD FOR FORMING A MOVABLE MATRIX IMAGE AND DEVICE FOR A LIGHT-EMITTING DIODE RUNNING LETTERS

(75) Inventors: Yuri Borisovich Sokolov, Fryazino (RU); Robert Pavlovich Baranov, Ryazan (RU); Vitaly Aleksandrovich Sviridov, Moscow (RU); Michail Viktorovich Strelnikov, Chimki (RU)

(73) Assignee: OOO Dis Plus Ltd., Moscow (RU)

( * ) Notice: Subject to any disclaimer, the term of this patent is extended or adjusted under 35 U.S.C. 154(b) by 943 days.

(21) Appl. No.: 11/754,233

(22) Filed: May 25, 2007

(65) Prior Publication Data

US 2007/0222722 A1 Sep. 27, 2007

Related U.S. Application Data

(63) Continuation of application No. PCT/RU2005/000432, filed on Aug. 24, 2005.

(30) Foreign Application Priority Data

Nov. 25, 2004 (RU) ..... 2004134375
Mar. 11, 2005 (RU) ..... 2005106592

(51) Int. Cl.
*G09G 3/00* (2006.01)

(52) U.S. Cl. ..... 345/31; 345/83

(58) Field of Classification Search ..... 345/31, 345/83, 76, 82, 91; 362/249.02, 545; 313/500; 315/169.3

See application file for complete search history.

(56) References Cited

U.S. PATENT DOCUMENTS

| | | | | |
|---|---|---|---|---|
| 5,670,971 | A | 9/1997 | Tokimoto et al. | |
| 6,069,595 | A | 5/2000 | Tokimoto | |
| 6,072,446 | A | 6/2000 | Tokimoto | |
| 7,573,190 | B2 * | 8/2009 | Hirosaki et al. | 313/503 |
| 7,688,347 | B2 * | 3/2010 | Dolgoff | 348/44 |

FOREIGN PATENT DOCUMENTS

| | | | |
|---|---|---|---|
| JP | 11-003051 | A | 1/1999 |
| JP | 2002-023700 | A | 1/2002 |
| JP | 2004-029802 | A | 1/2004 |
| WO | 87/01848 | A1 | 3/1987 |

* cited by examiner

*Primary Examiner* — Abbas Abdulselam
(74) *Attorney, Agent, or Firm* — Houston Eliseeva, LLP

(57) ABSTRACT

The set of inventions relates to display engineering and is used for displaying color alphanumeric and graphical information for designing and developing different infomercial display means on externally and internally located objects. The said invention makes it possible to improve the quality of displayed information, the operational reliability thereof and to reduce the costs by that the structural design and the arrangement of light clusters in the information desks of columns are optimized, and required dimensions of the information desks and the distance therebetween when a video field image is formed are determined. The elements of the running letters consist of two adjacent pixels having a common light-emitting-diode and the inventive arrangement configuration of the light-emitting-diodes in a pixel makes it possible to control the image resolution.

8 Claims, 3 Drawing Sheets

METHOD FOR FORMING A MOVABLE MATRIX IMAGE AND DEVICE FOR A LIGHT-EMITTING DIODE RUNNING LETTERS

RELATED APPLICATIONS

This application is a Continuation of PCT application serial number PCT/RU2005/000432 filed on Aug. 24, 2005 which claims priority to RU 2004134375, filed on Nov. 25, 2004 and RU 2005106592 filed Mar. 11, 2005 both of which are incorporated herein by reference in their entirety.

TECHNICAL FIELD

The group of inventions relates to display technology and can be used when designing display means for publicity messages at both indoor and outdoor objects, in the form of a light-emitting diode running letters to display color alphanumeric, graphic information and dynamic image with a scale of colors

BACKGROUND OF THE INVENTION

There is known method for forming a dot matrix image and information display device, in which they have used "after-image" effect appearing in human eye at fast movements of the display made on the base of light-emitting diodes (1).

One of the reasons impeding achievement of the required technical result when applying the known method for forming a matrix image and device is that this method does not allow to produce a display means, for example, for a running information line.

There is known method for forming a movable matrix image and display device produced by means of display bars, consisting of light-emitting diodes realizing "after-image" effect when displaying information (2).

One of the reasons impeding achievement of the required technical result when applying the known method for forming a movable matrix image and display device, is that by means of the same method on the display line elements and a movable image row are formed by non-color light-emitting diodes, therefore, one-color information is displayed.

The closest method of the same object matter to the declared method for forming a movable matrix image on the display consisting of "n" information bars containing pixels and arranged in parallel, at distance not less than information bar width, consisting in forming a moveable matrix image by information bars, in which an element of image line is formed by pixel of three light-emitting diodes of red, blue and green color, successively arranged along the information bar width and an element of image line is formed by adjacent pixels, arranged lengthwise the information bar (3).

One of the reasons impeding achievement of the required technical result when applying the known method for forming a movable matrix image taken for prototype, is that the method forms elements of lines and rows in a movable matrix image by means of not optimized by arrangement light-emitting diodes of color pixels, and this does not allow to increase resolution of the displayed information and quality of a movable matrix image respectively.

The closest device of the same object matter to the declared group is the device consisting of "n"-parallel among themselves information bars with a common power supply, columns of a movable matrix image with "after-image" effect in the displayed information video field are formed by means of information bars, each information bar contains light clusters of lines, each cluster is produced in the form of color pixels consisting of light-emitting diodes of red, green and blue luminescence colors and arranged linearly along the row line and pixel length is aligned with the width of information bar luminous column (3).

One of the reasons impeding achievement of the required technical result when applying the known device for alphanumeric and graphic information display, taken for prototype is that in this device information bars contain color display elements, produced in the form of a pixel of three color light-emitting diodes, successively arranged lengthways the displayed image line by means of which columns of video field image are formed, structurally are not optimized, which does not allow to increase resolution of the displayed information and quality of the displayed image video field respectively.

One of the reasons impeding achievement of the required technical result when applying the known device for alphanumeric and graphic information display, taken for prototype is that in this device information bars contain color display elements, produced in the form of a pixel of three color light-emitting diodes, successively arranged along the displayed image column, by means of which columns of video field image are formed, structurally are not optimized, which does not allow to increase resolution of the displayed information and quality of the displayed image video field in the display device respectively.

SUMMARY OF THE INVENTION

The nature of the invention consists in the following: the declared group of inventions solves problems of creating a method for forming a movable matrix image and device for a light-emitting diode running letters to display alphanumeric and graphic information, consisting of "n"-parallel information bars which form image columns.

When putting the invention into practice, the following uniform technical result can be achieved—quality improvement of the displayed information, increase of the operation reliability and reduction of the device cost due to resolution adjustment in columns of the video field displayed image, best arrangement of light-emitting diodes in pixel of light clusters and reduction of total number of light-emitting diodes.

The said technical result, when putting into practice a group of inventions by object—method for forming a movable matrix image is achieved by the way that in the known method for forming a movable matrix image on the display, consisting of "n"-information bars containing pixels and arranged in parallel at distance not less than information bar width, consisting in forming a moveable matrix image with "after-image" effect by means of information bars, in which an element of image line is formed by a pixel of three light-emitting diodes of red, blue and green color, successively arranged along the information bar width and an element of the image line is formed by adjacent pixels arranged lengthwise the information bar.

By means of image row information bars they form a movable matrix image, in which an element of image line is formed by two adjacent pixels, in which light-emitting diodes are arranged among themselves with formation of triangle figures. On top of the triangle adjacent corners they set a common light-emitting diode of one of three luminescence colors, herewith triangles, the sides of which are parallel to the width of image row information bar and in corners of these sides there are arranged light-emitting diodes of one luminescence color, form adjacent pixels lengthwise the lines.

Triangles, the sides of which are parallel to the length of image row information bar, in corners formed by these sides, light-emitting diodes of different luminous color are arranged, form adjacent pixels lengthwise the lines or along the image row. The distance between image row information bars is set multiple to the common length of adjacent pixels lengthwise the line element. In the element of image line adjacent pixels have a figure of equilateral triangle, in two adjacent pixels they set a common light-emitting diode of blue luminescence color, in two adjacent pixels they set a common light-emitting diode of green luminescence color, in two adjacent pixels they set a common light-emitting diode of red luminescence color. Forming a moveable matrix image by means of information bars of each element of the line, formed by two adjacent pixels, having a common light-emitting diode allows to reduce number of light-emitting diodes in row information bar. Light-emitting diodes arrangement in pixels with forming figures of triangles and attaining a common light-emitting diode on top of these triangles adjacent corners enables to produce adjacent pixels of a various arrangement configuration of light-emitting diodes in pixel concerning lines and rows, which allows to form a moving matrix image by means of information bars with resolution adjustment of displayed information. The opportunity to set a common light-emitting diode of different luminescence color in adjacent pixels of display element allows to display information of different kinds.

The said technical result when putting into practice a group of inventions by object—the device for a light-emitting diode running letters to display alphanumeric and graphic information of the first variant is achieved by the way that in the known device for a light-emitting diode running letters to display alphanumeric and graphic information, consisting of "n"-parallel among themselves information bars with a common power supply, columns of a movable matrix image with "after-image" effect in the displayed information video field are formed by means of information bars, each information bar contains light clusters of lines, each cluster is produced in the form of a color pixel consisting of light-emitting diodes of red, green and blue luminescence colors and arranged linearly along the row line and pixel length is aligned with the width of information bar luminous column. In information bar each light cluster of a line is produced in the form of a geometrical rectangle with diagonal length equal to double length of the smallest side arranged in parallel to column information bar by length. In the rectangle by diagonals crossing there are formed equilateral adjacent triangles, in corners of which there are color light-emitting diodes, by means of which two adjacent pixels of line light cluster are formed. Herewith, in triangle adjacent corners of color pixels there is a common light-emitting diode of one of three luminous colors and the width of light cluster is aligned with the rectangle smallest sides. Light clusters are arranged lengthwise the information bar at distance equal to the light cluster width. The sides of light cluster rectangle, parallel to information bar contain light-emitting diodes of red and green luminescence colors and a common light-emitting diode of adjacent pixels is of blue luminescence color. The sides of light cluster rectangle, parallel to information bar contain light-emitting diodes of blue and green luminescence colors and a common light-emitting diode of adjacent pixels is of red luminescence color. The sides of light cluster rectangle, parallel to information bar contain light-emitting diodes of red and blue luminescence colors and a common light-emitting diode of adjacent pixels is of green luminescence color. Information bars of the image columns are arranged among themselves at distance multiple to the width of information bar light cluster. Line light clusters of column information bar are produced in the form of a square, in the center of which there is light-emitting diode of one color out of red, green and blue luminescence colors and in the corners of the square there are light-emitting diodes of other luminescence colors. In information bars of the offered device for a light-emitting diode running letters light clusters are produced in the form of adjacent pixels from light-emitting diodes with different luminescence color. Light-emitting diodes arrangement in a pixel in the form of equilateral triangle, having pixel contiguity through the common top of corners in which a common light-emitting diode is arranged and having arrangement in corners of triangle sides parallel to the information bar length of light-emitting diodes of different luminescence color allows to adjust resolution of the video field displayed image and to optimize distance between information bars to achieve the required level of light intensity which improves detailed elaboration of image and allows to smooth color shades of image.

The said technical result when putting into practice a group of inventions by object—the device for a light-emitting diode running letters to display alphanumeric and graphic information of the second variant is achieved by the way that in the known device for a light-emitting diode running letters to display alphanumeric and graphic information, consisting of "n"-parallel among themselves information bars with a common power supply, in the displayed information video field columns of a moveable matrix image with "after-image" effect are formed by means of information bars. Each information bar contains light clusters produced in the form of a color pixel consisting of light-emitting diodes of red, green and blue luminescence colors and arranged linearly along the row line and pixel length is aligned with width of information bar luminous column. In the displayed information video field distance between columns of information bars is specified based on ratio: $R=(5\div15)L$, where R is the distance between information bars; L is the light cluster length, herewith the length of column information bar is selected based on ratio: $S=L\times m$, where S is the length of column information bar; L is the light cluster length; m is number of light clusters in column information bar of video field and the information bar width is specified by ratio: $Lp=(2\div4)L$, where Lp is the information bar width; L is the light cluster length. The displayed information video field is produced from 72 information bars, information bars are combined in groups consisting of 9 information bars, column information bars of each group are connected to a separate power supply and in order to input signals information bars are successively connected among themselves in the direction of image scanning in the video field, herewith signal input of the first column information bar of image scanning start is connected to controller output, controller input is connected to flash card.

The suggested selection of the distance between information bars, considering the length of color display element allows to provide necessary brightness of the video field and the selected length of information bar considering the width of information bar color element provides the best resolution of displayed image and overall dimensions required to view displayed information from different distances. Besides, the display device is produced with a reduced number of elements, which decreases its cost and information bar combination in a group with a separate power supply decreases the value of current impulse amplitude in supply rails of light-emitting diodes of the device, which reduces the probability of noise occurrence in drive circuits of light-emitting diodes, enhances operation reliability and control of the device for a light-emitting running letters.

To check the conformity of the declared group of inventions to the requirement of the inventive level there was completed an additional retrieval of the known solutions, with the purpose of revealing the attributes coinciding with different ones from the chosen prototype of the declared invention. The results show that each variant from the declared group of inventions does not follow for an expert explicitly from the known level of techniques as there have not been revealed any technical solutions, in which the device for a light-emitting diode running letters with "after-image" effect would be produced by means of information bars with color display elements formed by two adjacent pixels with a common light-emitting diode of one of three luminescence colors. Herewith light-emitting diodes of pixels are arranged in the form of equilateral triangle figure, which allows pixels to adjust resolution, depending on the kind of displayed information, as well as to increase light intensity.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

Figure 1:
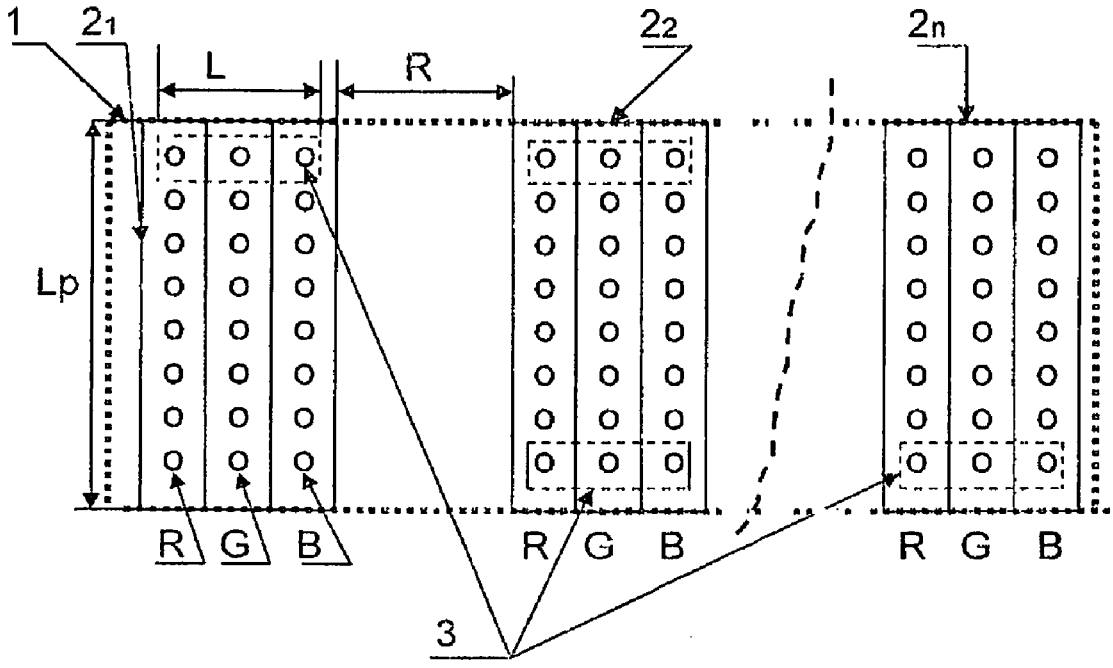
FIG. 1 shows pixel of the display element of column information bar of prototype image.

Forming a moveable image with "after-image" effect in prototype is produced by means of the display device with video field borders of image 1 (FIG. 1), consisting of "n"-information bars of image columns 21, 22 and 2*n*. Each column information bar of image 2 with S length contains color display elements of lines 3 with L length, in which each pixel consists of three color diodes: red—R, green—G and blue—B, arranged horizontally lengthwise the line. Column information bars of image 2 on the display of video field 1 are arranged in parallel and at R distance, which is not less than the length of line 3 light cluster of column 2 information bar.

Figure 2A:
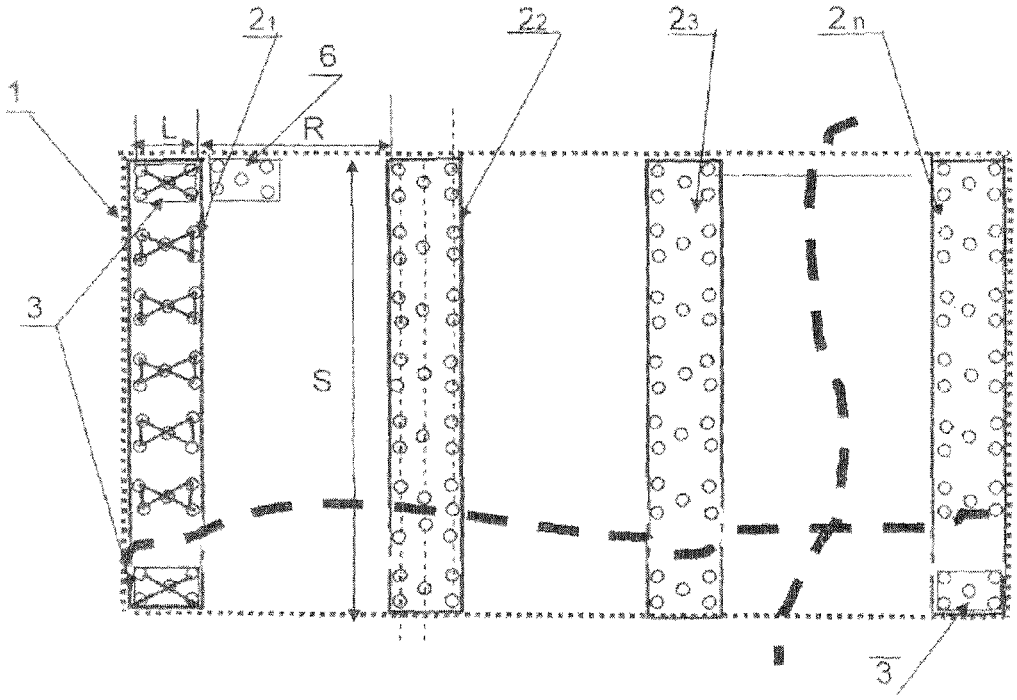
FIG. 2 shows information bar display element in the form of a cluster in the offered light-emitting diode running letters to display alphanumeric and graphic information, where image video field is formed by column information bars by means of different geometry figures of light cluster performance, having different arrangement of light-emitting diodes pixels in them.

FIG. 2*a* shows the image video field with borders 1 of the offered light-emitting diode running letters to display alphanumeric and graphic information. The video field is formed by "n"-information bars of columns 2 located at R distance, which is chosen multiple to L length of line 3 light cluster based on ratio R/L=1, 2, 3 . . . m. The maximum value of m is specified by value of the required brightness of the image entire field.

Figure 2B:
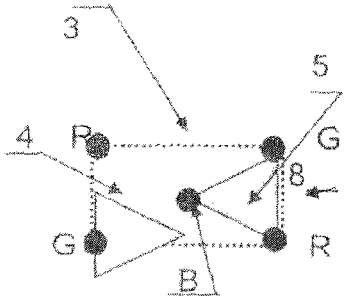
Figure 2C:
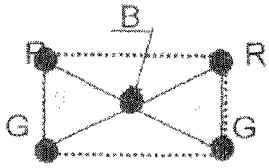
Figure 2D:
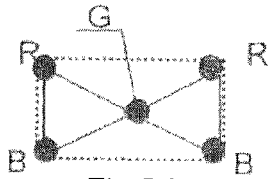
Figure 2E:
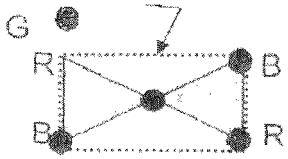
Figure 2F:
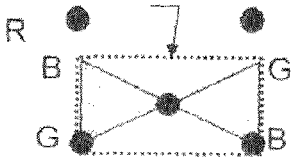

FIG. 2*b* shows light cluster 3, produced in the form of geometrical rectangle, in which each diagonal length is equal to twice the smallest side length and when they cross, there are formed equilateral adjacent triangles, in which corners color light-emitting diodes B, G, R are arranged. This is an equilateral triangle RBG, clockwise, and an equilateral triangle BRG. These equilateral triangles form two adjacent pixels 4 and 5 with a common light-emitting diode B. This light cluster enables to modify image resolution in columns horizontally and vertically.

Figure 2G:
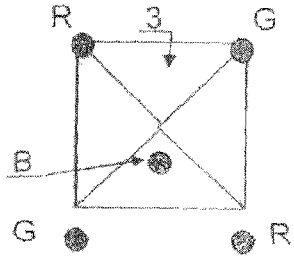

FIG. 2*c*, 2*d*, 2*e*, 2*f* show examples of light clusters 3 of information bars 2, with a different arrangement of color light-emitting diodes in adjacent pixels and in FIG. 2*g* there is shown light cluster, produced in the form of a square.

Figure 3:
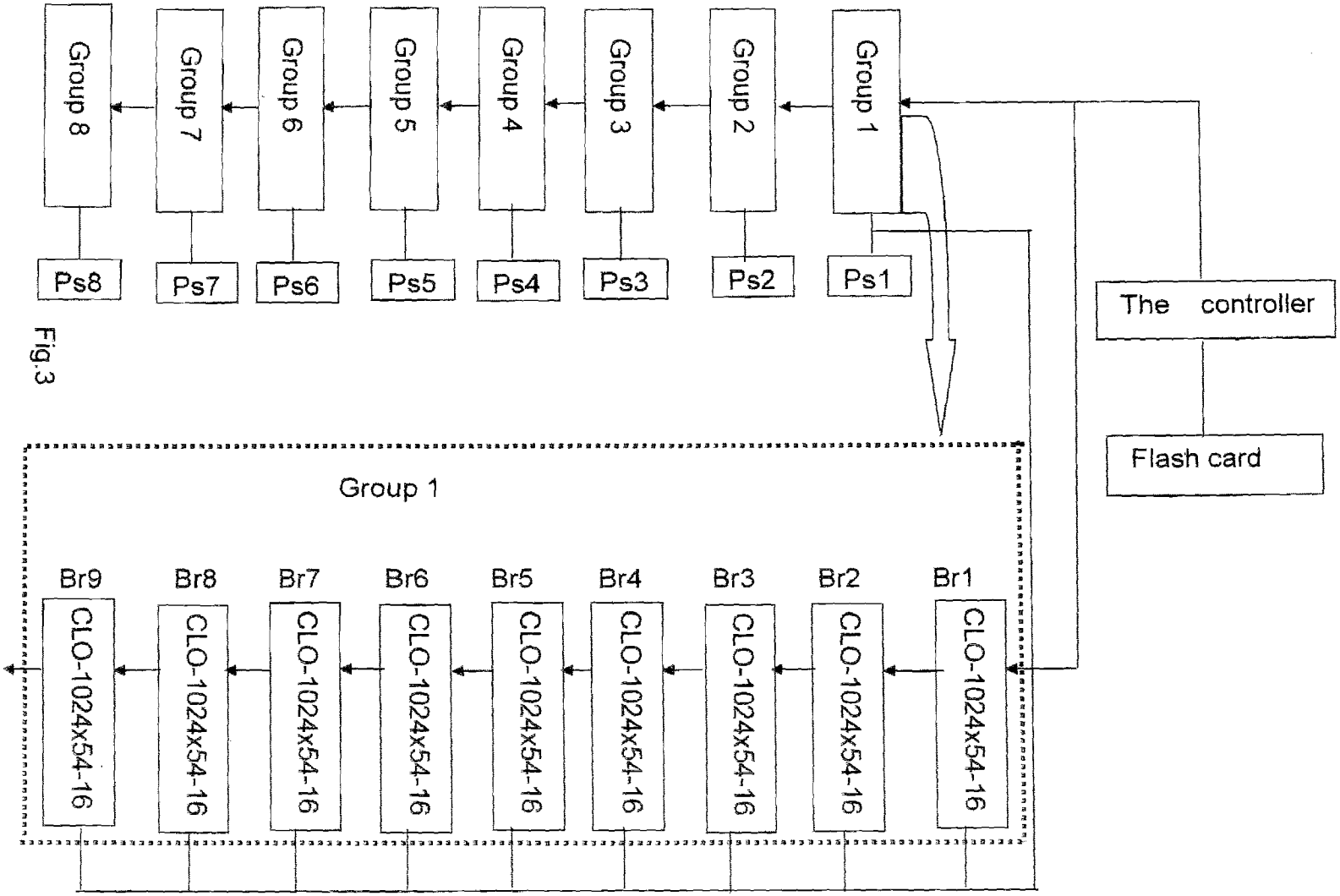
FIG. 3 shows a block diagram of the device for a light-emitting diode running letters to display alphanumeric and graphic information, in which information bars by power supplies are combined in groups.

FIG. 3 shows a block diagram of the light-emitting diode running letters to display alphanumeric information.

DETAILED DESCRIPTION OF THE PREFERRED EMBODIMENTS

The operation principle of light-emitting diode running letters to display alphanumeric and graphic information is based on the method for forming a moveable matrix image on "after-image" effect, which is defined by particular qualities of the human eyesight to memorize image and to overlay the memorized image to the one displayed at the current moment. The human eye follows the image, applies the current image to the previous one and as a result there happens an illusion of the united image, though actually it consists of a certain number of fragments. A fragment consists of line and row elements, which are formed by information lines. In FIG. 2*a* there is shown line 6 imaginary element among information bars of image 2 rows. The offered device is realized in the "Light-emitting diode running letters" product to display color alphanumeric and graphic information «INCOTEX-Display System» LOR CLO-1024×54-16-00 and block diagram (FIG. 3) in each information bar (FIG. 2), L length of light cluster 3 is equal to 16 mm, 54 mm is the width of information bar in accordance with ratio Lp=(2÷4)L, and S length of device information bar is equal to ratio S=L×m=16×64=1024 mm, where 64 is number of light clusters. The block diagram of light-emitting diode running letters to display alphanumeric information (FIG. 3) shows, that it consists of 72 information bars of 2 image columns, which form the video field.

Information bars are combined in 8 groups and each group contains 9 information bars of CLO-1024-54-16 type. Each group of information bars is connected to power supply Ps (1-8). R is the distance between column information bars and between groups of information bars is selected equal to 176 mm and corresponds to ratio R=(5÷15)L. Ratio 11 corresponds to the selected distance R=176 mm. Information bars by information signal input are connected successively from right to left (FIG. 3). In the first information bar Bar1 information signal input is connected to signal output from controller connected to flash card. Information moves along the video field with the rate of about 5 km/s.

Thus, the offered group of inventions reduces number of light-emitting diodes, which as a whole decreases cost of the information display device, thus allows to form the qualitative dynamic image with a color scale from 64 up to 4096 shades.

While this invention has been particularly shown and described with references to preferred embodiments thereof, it will be understood by those skilled in the art that various changes in form and details may be made therein without departing from the scope of the invention encompassed by the appended claims.

What is claimed is:

1. A light-emitting diode running image display comprising:

parallel display bars comprising rectangular light clusters positioned along the bars, the light clusters forming lines of a moveable image with after-image effect across the bars, a common power supply, wherein a diagonal length of each light cluster is equal to twice a length of a shorter side of each light cluster, so that diagonal crossing forms equilateral adjacent triangles, wherein in the corners of the equilateral adjacent triangles are color light-emitting diodes forming two adjacent pixels of a line light cluster, wherein in adjacent corners of color pixel triangles is a common light-emitting diode of one of three luminescence colors, and wherein the light clusters are arranged along the display bars.

2. The light-emitting diode running image display of claim 1, wherein the sides of the light cluster parallel to the bar length comprise light-emitting diodes of red and green colors and wherein common diodes of adjacent pixels are blue.

3. The light-emitting diode running image display of claim 1, wherein the sides of the light cluster parallel to the bar length comprise light-emitting diodes of blue and green colors and wherein common diodes of adjacent pixels are red.

4. The light-emitting diode running image display of claim 1, wherein the sides of the light cluster parallel to the bar length comprise light-emitting diodes of red and blue colors and wherein common diodes of the adjacent pixels are green.

5. The light-emitting diode running image display of claim 1, wherein the bars are at distance from each other, the distance being a multiple of a width of a light cluster.

6. The light-emitting diode running image display of claim 1, wherein the light clusters of the bars are square, wherein a light-emitting diode of a color chosen from red, green and blue is in the center of the square, and wherein light-emitting diodes of other luminescence colors are in four corners of the square.

7. The light-emitting diode running image display of claim 1, wherein the distance between the bars is from 5L to 15L, where L is a light cluster length;

wherein the length of the bar is L×m, where L is the light cluster length and m is the number of light clusters in the bar, and wherein the bar width is from 2L to 4L, where L is the light cluster length.

8. The light-emitting diode running image display of claim 7, comprising 72 bars forming groups of 9 bars each, a controller comprising an input and an output, and a flash card connected to the controller input;

wherein bars of each group are connected to a separate power supply for each group, wherein the bars are connected for signal transmission in a direction of image scanning in the video field, and wherein a signal input of the bar where image scanning starts is connected to the controller output.

* * * * *